US007627993B1

(12) United States Patent
Letizi

(10) Patent No.: US 7,627,993 B1
(45) Date of Patent: Dec. 8, 2009

(54) METHOD AND APPARATUS FOR GEODESIC SPHERE CONSTRUCTION

(76) Inventor: Anthony Louis Letizi, 6678 Eagle Ridge Rd., Penngrove, CA (US) 94951

( * ) Notice: Subject to any disclaimer, the term of this patent is extended or adjusted under 35 U.S.C. 154(b) by 470 days.

(21) Appl. No.: 11/424,223

(22) Filed: Jun. 14, 2006

(51) Int. Cl.
*E04B 7/00* (2006.01)

(52) U.S. Cl. ..... 52/82; 52/653.1; 52/655.1

(58) Field of Classification Search ..... 52/81.1, 52/81.2, 81.3, 81.4, 82, 655.1, 656.9, 653.1, 52/DIG. 17; 403/171, 176, 217
See application file for complete search history.

(56) References Cited

U.S. PATENT DOCUMENTS 4,009,543 A * 3/1977 Smrt ..... 52/81.2
4,136,408 A * 1/1979 Dahlbeck et al. ..... 4/498
4,491,437 A * 1/1985 Schwartz ..... 403/172
4,521,998 A * 6/1985 DeLorme ..... 52/81.3
4,567,707 A * 2/1986 Herman ..... 52/653.1
4,621,467 A * 11/1986 Golden ..... 52/81.1
4,923,322 A * 5/1990 Burg ..... 403/234
5,115,828 A * 5/1992 Spaulding ..... 135/142
5,598,668 A * 2/1997 Isom ..... 52/86
5,655,558 A * 8/1997 Child ..... 135/97
5,867,961 A * 2/1999 Castano ..... 52/653.1
6,321,502 B1 * 11/2001 Castano ..... 52/653.2
6,345,638 B1 * 2/2002 Warner ..... 135/123
6,539,571 B1 * 4/2003 Forsyth ..... 14/14
6,668,495 B1 * 12/2003 Prince ..... 52/63
6,708,455 B1 * 3/2004 Niiduma ..... 52/81.2
6,745,521 B1 * 6/2004 Klemming ..... 52/79.6

* cited by examiner

*Primary Examiner*—Gay Ann Spahn
*Assistant Examiner*—Joshua K. Ihezie
(74) *Attorney, Agent, or Firm*—Craig M. Stainbrook; Stainbrook & Stainbrook, LLP

(57) ABSTRACT

A method and apparatus for geodesic sphere construction provides a construction framework from an extrusion system that, when fabricated, generates the geometries of the geodesic sphere or dome, and also is configured to interlock with the triangular exterior panels to form a waterproof system. The apparatus includes an extruded strut portion having a cross-section, and a vertex component having the same cross-section, with a sliding connector portion adapted to slide into and join the strut portion and vertex component to form the geodesic frame work of a geodesic strut and panel system. The extruded strut and vertex components have a centerline bearing opposing dihedral angles. The vertex connectors are each set at the appropriate face angle and axial angle according to their location on the geodesic structure. Thus, the vertex component generates both the surface angles on a geodesic sphere and the axial angles which produce the curvature of the geodesic dome.

4 Claims, 8 Drawing Sheets

METHOD AND APPARATUS FOR GEODESIC SPHERE CONSTRUCTION

SEQUENCE LISTING

Not applicable.

CROSS REFERENCE TO RELATED APPLICATIONS

Not applicable.

STATEMENT REGARDING FEDERALLY SPONSORED RESEARCH OR DEVELOPMENT

Not applicable.

REFERENCE TO A MICROFICHE APPENDIX

Not applicable.

THE NAMES OR PARTIES TO A JOINT RESEARCH AGREEMENT

Not applicable.

INCORPORATION-BY-REFERENCE OF MATERIAL SUBMITTED ON A COMPACT DISC

Not applicable.

TECHNICAL FIELD

The present invention relates generally to geodesic domes, and more particularly to an improved strut and panel system for the construction of a waterproof geodesic dome having low profile skylights.

BACKGROUND INFORMATION AND DISCUSSION OF RELATED ART

U.S. Pat. No. 4,408,422 to Bechtold discloses a skylight assembly provided to be mounted to cover an opening in a roof structure. The assembly includes a liner adapted to be mounted adjacent the edge of the opening in the roof structure around the periphery to surround the opening and to form a wall extending upward from the roof structure. An outer dome and an inner dome are provided with the domes spaced and the outer dome overlying the inner dome. Both of the domes engage a sealing gasket positioned on the liner wall. A supporting frame is coupled to the dome and sealing gasket arrangement and the frame and arrangement are hinged to the liner to permit shifting thereof with respect to the liner between a closed position overlying the opening in the roof structure and an open position permitting access to the opening from the exterior of the roof structure. The supporting frame has a U-shaped end portion to receive the peripheral edge portion of the outer dome therein and thereby support the outer dome. The manner of engagement between the frame and the outer dome enables the assembly to resist significant tension forces. A weep hole is provided in the frame to alleviate the danger of condensation in the portion of the outer dome enclosed by the frame and gasket. The exposed peripheral edge of the outer dome is protectively enclosed.

U.S. Pat. No. 4,625,472 to Busick describes a geodesic dome construction system utilizing a plurality of prefabricated panels having a triangular shape. Each panel includes a core of insulative material, an exterior cementitious face, an interior wall surface face, and edges of the core at an angle with respect to the faces. The exterior face includes an uncovered border portion and a wire mesh extending from the cementitious face into the border portion. The panels are assembled edge-to-edge to form a dome and the joints between panels reinforced with a wire mesh strip. The border portions and exposed wire mesh are covered with cured cementitious material forming a reinforced concrete rib along each joint.

U.S. Pat. No. 5,103,603 to Verby et al. teaches an openable skylight assembly which covers a roof opening having a raised curb around its perimeter that extends substantially perpendicularly from the roof surface. The skylight includes glazing means that substantially covers the opening. A frame assembly surrounds the glazing means, and has a depending skirt portion that opposes the outer surfaces of the curb. A hinge, joining one side of the frame to the curb so that the skylight frame may be pivoted to open the skylight, includes a generally circular bearing that is received in a cradle, which is an integral part of the frame assembly that holds the glazing means. The internal curved cradle surface has an arc exceeding 180.degree. such that the bearing and cradle cannot be separated except when flat surfaces provided on the bearing align with the opening between the ends of the curved cradle surface. Then, by transverse motion relative to the longitudinal axis of the hinge, the frame assembly separates from the curb. No tools are required for removal and attachment of the movable skylight cover to the curb.

U.S. Pat. No. 5,148,643 to Sampson et al. discloses a skylight construction having a wooden base frame extending about a roof opening and secured to the roof. The skylight construction is illustrated as a step flash skylight including a rigid plastic curb frame having a base frame and overlying sash frame. A retainer is provided for supporting glazing plates over the sash frame. The PVC base frame is firmly secured to the wooden base frame by interlocking with the wooden base frame. Hinge members interconnect a base frame and sash frame of the rigid curb frame providing water tight sealing between the hinge members.

U.S. Pat. No. 5,207,036 to Sampson et al. describes a skylight construction having a wooden base frame extending about a roof opening and secured thereto. The skylight construction is illustrated as a step flash skylight including a rigid plastic curb frame having a base frame and overlying sash frame. A retainer is provided for supporting glazing plates over the sash frame. The PVC base frame is firmly secured to the wooden base frame by interlocking therewith. The PVC base frame has a peripherally disposed counterflashing piece extending downwardly therefrom and having flashing seal means disposed intermediate the counterflashing piece and the wooden base frame.

U.S. Pat. No. 5,669,186 to Verby et al. teaches an openable skylight apparatus covering a roof opening having a raised curb around its perimeter. The skylight including glazing that substantially covers the opening. A frame assembly surrounds the glazing and has a depending skirt that opposes outer surfaces of the curb. A hinge, joining one side of the frame to the curb includes a bearing within a cradle that allows the frame assembly to pivot to open the skylight. The cradle has a lower and a higher end and extends by an arc greater than 180 degrees and less that a full circle between the ends. The bearing has a periphery that includes a convex surface, two chordal flat surfaces converging toward a lower convex surface and a higher convex surface diametrically opposite the other. When the bearing is rotated to a position in which the lower convex surface is at a higher elevation than the lower end of the cradle, the bearing may be pulled out of the cradle to separate the frame assembly from its hinged connection with the curb.

U.S. Pat. No. 6,173,547 to Lipson discloses a building system comprised of panelized, modified rhombic triacontahedral structures further comprised of panels continuously connected along their edges by connectors whose profiles allow panels to swing, snap or slide together into strong, insulated buildings and unfasten for easy disassembly and re-use as temporary housing, storage, emergency shelter, work-camp and vacation homes. Vertical walls allow structures to be nested or mated together and allow use of standard doors, windows and fixtures. The connector is formed from extruded or cast plastic or aluminum, or formed steel. Carbon fiber reinforced resin may be used for specialized uses. The connector allows the use of a variety of standard manufacture laminated panels. The basic structure is comprised of ten identical wall panels and ten almost-identical roof panels joined by use of 35, 144 degree edge connectors. A minimum tripartite inventory, each of identical, easily mass produced parts, provides ease of production, shipping and assembly. The extruded plastic edge connector is easy to manufacture in relatively small scale industrial facilities. The edge connector and light-weight panel system increases efficiency, lowers costs and creates extraordinary ease of assembly and disassembly. A structure with a larger, rectangular entryway is created by use of a 126 degree connector along three facing edges, bisecting one lower ring roof panel and replacing two basic wall panels with two rectangular panels or one double wide rectangular panel. This creates a structure having a wall with a larger entry capability obviating the need to otherwise increase structure size. Eliminating one entire lower roof panel; extending two wall panels to meet the upper roof ring instead of the lower roof ring and use of a 108 degree connector on five facing edges creates a concave building wall. The concavity is complementary to adjoining walls of a second structure and allows nesting of the structures.

The foregoing patents reflect the current state of the art of which the present inventor is aware. Reference to, and discussion of, these patents is intended to aid in discharging Applicant's acknowledged duty of candor in disclosing information that may be relevant to the examination of claims to the present invention. However, it is respectfully submitted that none of the above-indicated patents disclose, teach, suggest, show, or otherwise render obvious, either singly or when considered in combination, the invention described and claimed herein.

SUMMARY OF THE INVENTION

The method and apparatus for geodesic sphere construction of the present invention provides a construction framework from an extrusion system that, when fabricated, generates the geometries of the geodesic sphere or dome, and also is configured to interlock with the triangular exterior panels to form a waterproof system. The strut, panel, and skylight system utilizes components that are easy to transport and assemble, and produces structures that are waterproof, beautiful, extraordinarily sturdy, and fireproof.

The inventive apparatus includes an extruded strut portion having a cross-section, and a vertex component having the same cross-section, with a sliding connector portion adapted to slide into and join the strut portion and vertex component to form a geodesic framing member. The extruded strut and vertex components have a centerline bearing opposing dihedral angles. In addition, the vertex connector is fabricated to the correct axial angles and face angles regardless of the fabrication method used (e.g., whether cast aluminum or cut and welded aluminum). Thus, the vertex connector sets the appropriate face angles, dihedral, and axial angles which produce the curvature of the geodesic dome.

The geometry for a geodesic structure is generated from any of the polyhedron forms. Using spherical trigonometry, the polyhedron form is expanded onto a spherical surface. The basic spherical polyhedron is then subdivided one or more times along an edge length (termed "geodesic frequency"). Water leaks occur most frequently where the framing members converge at a vertex point. To avoid a condition that is impossible to weatherproof (i.e. where the framing members are converging at a vertex point and expanding and contracting due to weather fluctuations) this system employs a fabricated and welded vertex component, or a sand-cast aluminum vertex component.

It is therefore an object of the present invention to provide a new and improved geodesic sphere construction.

It is another object of the present invention to provide a new and improved waterproof geodesic sphere.

A further object or feature of the present invention is a new and improved extrusion for geodesic sphere construction.

An even further object of the present invention is to provide a novel strut and vertex construction for geodesic spheres.

Other novel features which are characteristic of the invention, as to ease of assembly and methods of construction, together with further objects and advantages thereof will be better understood from the following description considered in connection with the accompanying drawings, in which preferred embodiments of the invention are illustrated by way of example. It is to be expressly understood, however, that the drawings are for illustration and description only and are not intended as a definition of the limits of the invention. The various features of novelty which characterize the invention are pointed out with particularity in the claims annexed to and forming part of this disclosure. The invention resides not in any one of these features taken alone, but rather in the particular combination of all of its structures for the functions specified.

There has thus been broadly outlined the more important features of the invention in order that the detailed description thereof that follows may be better understood, and in order that the present contribution to the art may be better appreciated. There are, of course, additional features of the invention that will be described hereinafter and which will form additional subject matter of the claims appended hereto. Those skilled in the art will appreciate that the conception upon which this disclosure is based readily may be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the Abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The Abstract is neither intended to define the invention of this application, which is measured by the claims, nor is it intended to be limiting as to the scope of the invention in any way.

Certain terminology and derivations thereof may be used in the following description for convenience in reference only, and will not be limiting. For example, words such as "upward," "downward," "left," and "right" would refer to directions in the drawings to which reference is made unless otherwise stated. Similarly, words such as "inward" and "outward" would refer to directions toward and away from, respectively, the geometric center of a device or area and designated parts thereof. References in the singular tense include the plural, and vice versa, unless otherwise noted.

BRIEF DESCRIPTION OF THE DRAWINGS

The invention will be better understood and objects other than those set forth above will become apparent when consideration is given to the following detailed description thereof. Such description makes reference to the annexed drawings wherein.

DETAILED DESCRIPTION OF THE INVENTION

Figure 1:
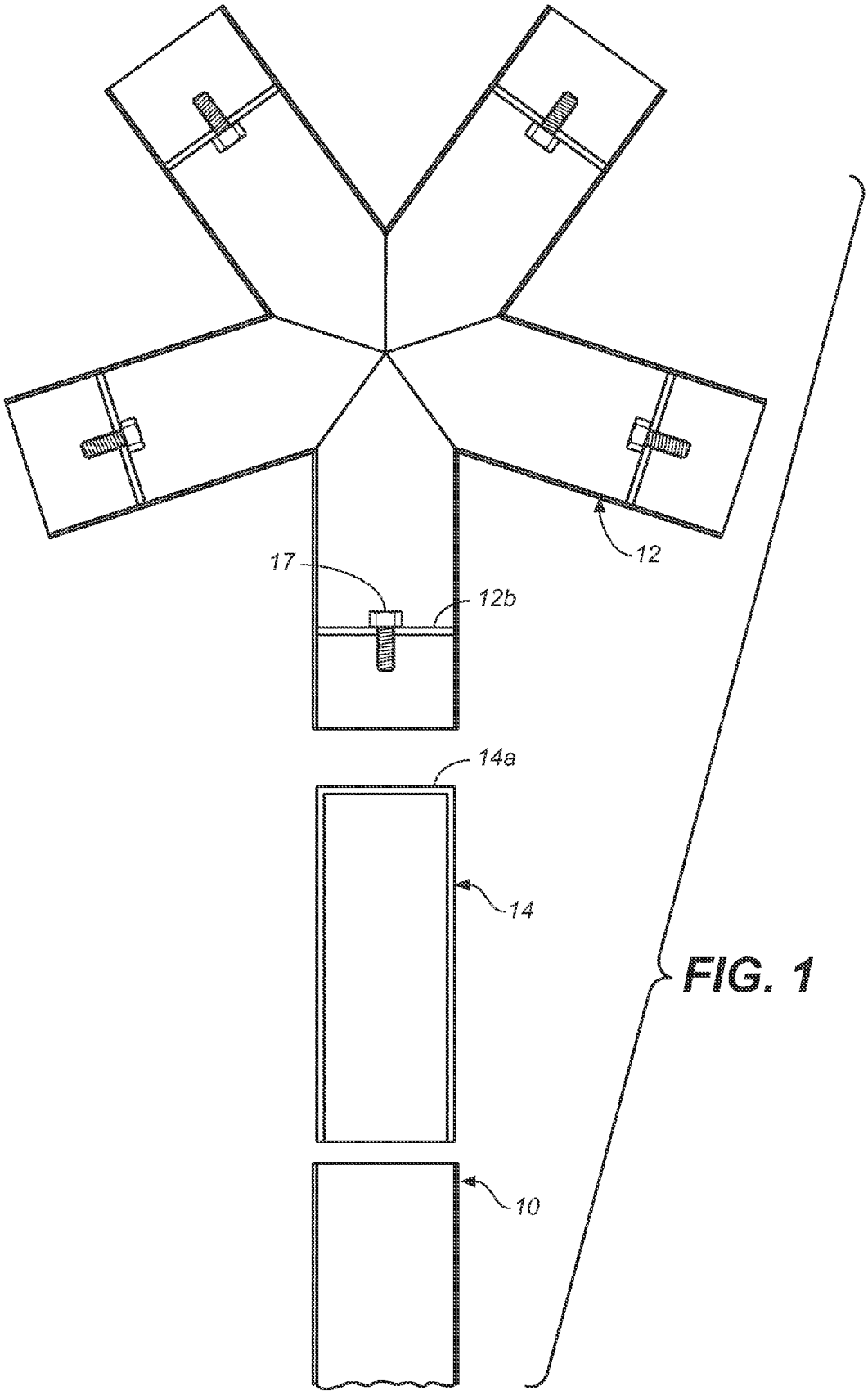
FIG. 1 is an exploded plan view of the framework components of the apparatus for geodesic sphere construction of this invention.

Referring to FIGS. 1 through 8, wherein like reference numerals refer to like components in the various views, there is illustrated therein a new and improved apparatus for geodesic sphere construction of this invention.

GEODESIC FRAMEWORK

FIG. 1 is an exploded plan view of the framework components of the apparatus for geodesic sphere construction of this invention. The framework of the system is made of three basic components: The framing member or strut 10, the vertex component 12, and the sliding connector 14 that slides into place inside the other two framing components and joins them together.

Figure 2:
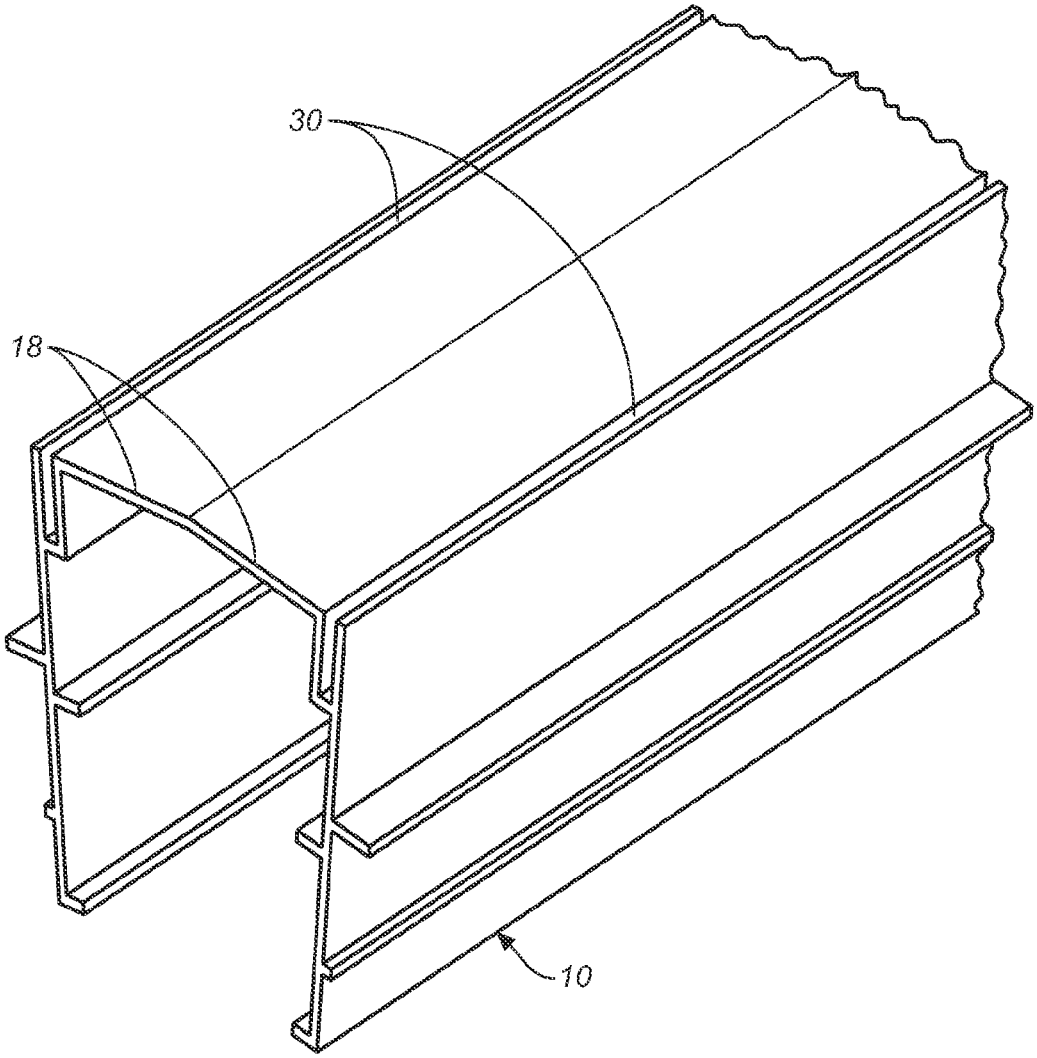
FIG. 2 is a perspective view of a strut component of this invention.

FIG. 2 is a perspective view of a strut component. Strut 10 and vertex 12 are fabricated from the same extrusion. When fabricated as the strut 10, this extrusion is simply crosscut to the exact length required. The dihedral angles of a geodesic dome (the interior angles between the dome panels) are different for each panel. However the difference between all of the dihedral angles (on a four frequency icosahedron) varies by less than two degrees. This invention takes the median average of the dihedral angles and builds that angle into the form of the extrusion from which strut 10 and vertex 12 are fabricated. As shown in FIG. 2, the dihedral angles 18 are set as opposing angles down the centerline of the extrusion. This aspect of the invention greatly simplifies the process of translating the pure mathematics of a geodesic sphere into a practical system for the construction of a geodesic building. When using this extrusion and this system of construction, the builder does not have to worry about factoring all of the complex angles of a geodesic structure because all of the geometry is built into the system components.

Figure 3:
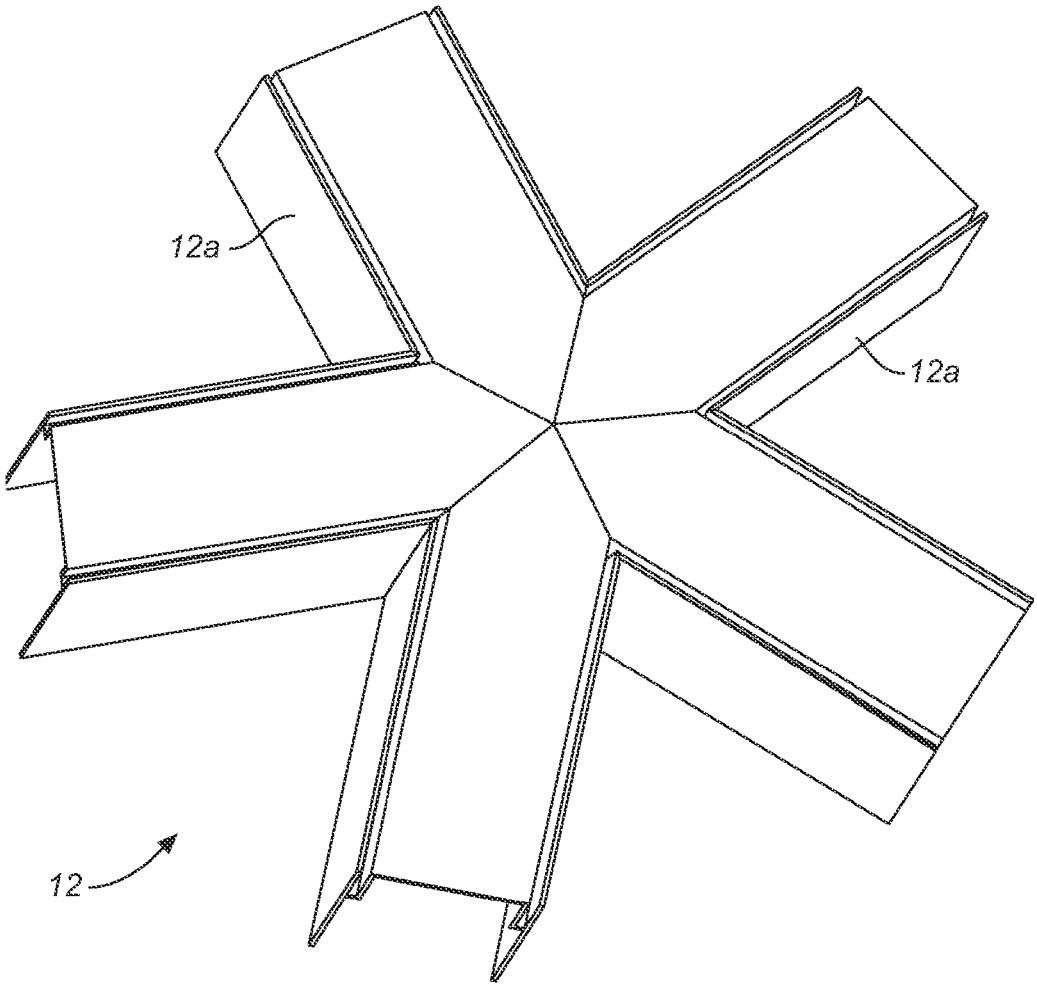
FIG. 3 is a perspective view of a vertex component of this invention.

FIG. 3 is a perspective view of a vertex component 12 of this invention. When used as the vertex component 12, the extrusion is fabricated in the following manner: it is crosscut into short lengths (approximately 16" long), and each strut segment piece 12*a* is saw-cut with a compound miter-cut at one end. The components are then assembled onto a welding jig. The welding jig is set up with the same axial angles and face angles that were compound miter-cut on each of the pieces. The individual parts are then continuously welded on both the inside and outside surfaces into one unitized vertex component 12. As a result of this fabrication technique, the vertex component generates both the surface face angles (triangles) on a geodesic sphere and the axial angles which produce the curvature of the geodesic dome. As previously mentioned, the shape of the extrusion generates the dihedral angles so that once fabricated, the vertex component of this invention will generate all of the necessary geometry required in a geodesic structure. When assembled with the sliding connector and the struts, the unitized construction of the vertex component locks the struts into place. This assembly solves the waterproofing problem previously mentioned, that is, of converging struts unintentionally moving around at the intersections or vertex points. The vertex component itself is waterproof because it has been continuously welded together on both inside and outside surfaces. An equally effective alternate method of fabricating the vertex component is to utilize the "sand cast" method for casting this component from molten aluminum producing a one-piece waterproof vertex connector. When using the sand cast method of fabrication, the continuous slot 30 is fabricated after casting by maching cutting the slot into the cast aluminum vertex connector.

CREATING STRUCTURAL TENSION IN THE FRAMEWORK

Figure 4:
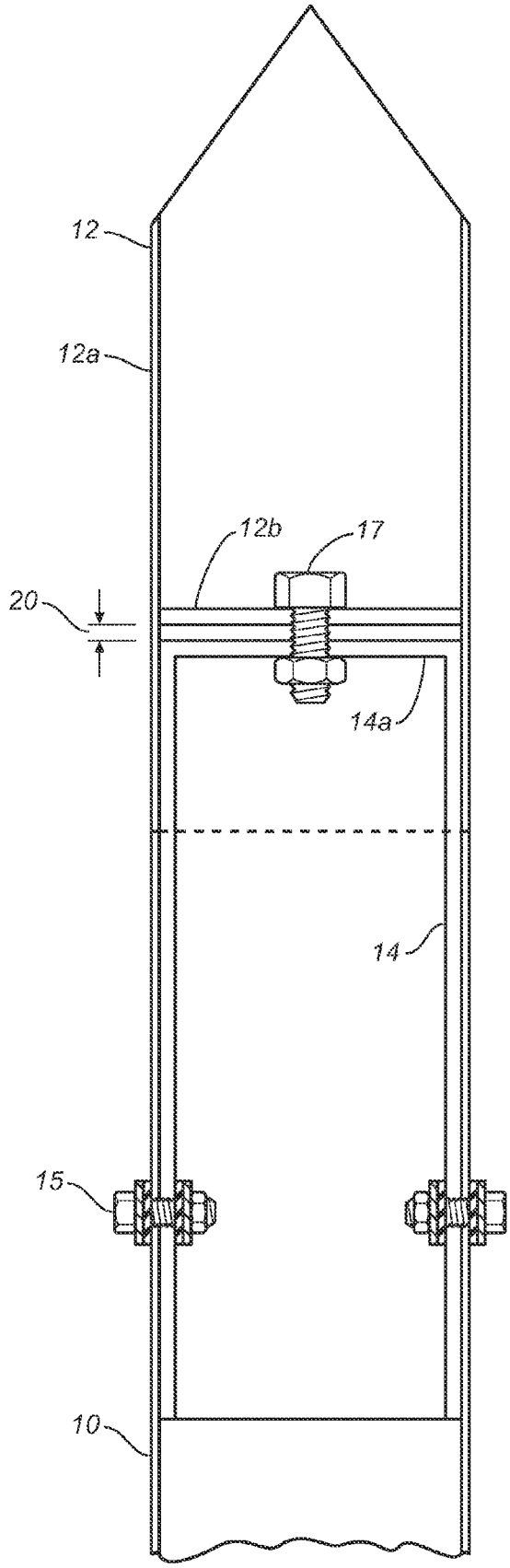
FIG. 4 is a bottom plan view of a strut, vertex, and sliding connector of this invention as assembled.

FIG. 4 is a bottom plan view of a strut, vertex, and sliding connector of this invention as assembled. On the inside of each strut segment 12*a* of the vertex component 12, a cross member 12*b* is welded for the purpose of bolting the vertex component 12 to the sliding connector 14. This cross-piece has a preferred dimension of 9/16" diameter bolt-hole (for a ½" bolt) machined into the center of the cross member. This piece measures: 2" (wide)×¼" (thick) and serves as the point of connection between sliding connector cross member 14*a*. This component is designed to slide on the inside surface of both the strut 10 and vertex component 12 and structurally connects the two components together. In its final location sliding connector 14 is located on the inside of the vertex connector 12 and strut 10. It is designed to nest inside both parts and slide into place during assembly. Sliding connector 14 is situated between the vertex component and the strut end at the point of connection between the two parts. After sliding connector 14 is set into its correct location, it is bolted through the sides of the strut 10 with two ⅜" diameter bolts 15 on each side so that it now becomes a permanent part of the strut. A ½" diameter bolt 17 connects through the cross member 14*a* of sliding connector 14 and the cross member 12*b* of the vertex component 12 and when tightened, pulls the two parts together. A small gap between the strut 10 and the vertex 12 is calculated into the design of the structure by positioning and then bolting sliding connector 14 to the strut 10 so that it becomes a permanent extension of the strut with a small (⅛") gap 20 deliberately placed or set between the end of the strut 10 and the vertex component 12. When the bolt and nut are tightened together they compress the vertex component 12 and the sliding connector 14 (which has been permanently bolted to the strut and is no longer sliding anywhere) together which closes the gap between the strut and vertex component. This gap is intended for tensional tuning only. The gap must be closed to produce a mathematically correct structure.

Geodesic structures are intrinsically tension oriented (i.e. they are in continuous tension throughout the structure). Allowing a small gap between the strut 10 and vertex 12 to be closed by the action of the bolt and nut compressing the three components together produces localized compression. But this action also amplifies and introduces the process of tensioning throughout the framework of the structure by pulling the struts closer together. This process is analogous to tightening the spokes of a bicycle wheel to produce a rigid tensional tuned wheel.

Since the struts and the vertex component are fabricated from the same aluminum extruded profile the two components match up perfectly, but there is nothing to support the point of connection between the two parts. The point of connection between the vertex component 12 and the strut 10 is structurally strengthened, aligned and protected from water infiltration at the joint by sliding connector 14. This component functions as both a connecting piece and a structural support underneath the point of connection between the strut and the vertex component. At the butt joint where the strut and vertex are joined both of these parts rest on the sliding connector 14. In order to waterproof this condition at the butt joint, the outside surface of the sliding connector 14 is coated with a layer of polyurethane sealant. Although the sliding connector 14 slides into place on the inside of strut 10 and vertex 12, the space between the two extrusions is only 1/32". The polyurethane sealant is viscous enough to allow the sliding connector to slide into place during assembly. Once in position, the sliding connector is no longer moveable. This component is bolted into place and when the polyurethane cures it fills the 1/32" space between the components and becomes a waterproof bonding agent. The point of connection between all three components (strut, vertex, and sliding connector) becomes permanent, rigid, and waterproof.

As mentioned previously, the sliding connector 14 (before it becomes permanently installed) is designed to slide inside of strut 10 and vertex 12. The advantage of having one part slide back and forth within the strut and vertex components is extremely important because it allows the complex form of the geodesic to be easily assembled. During the assembly of the framework, the connection between the struts and the vertex component is very tight and would be impossible to fit together without the ability of the "sliding connector" to retract into the interior of the strut until the connection is made between the strut and vertex. Then the "sliding connector" is extended from the inside of the strut into the vertex component and bolted into place, securing the connection between the strut and vertex. This system of the interaction and final configuration between the strut, vertex, and sliding connector comprises the outside framework system.

DOME INTERIOR

Figure 5:
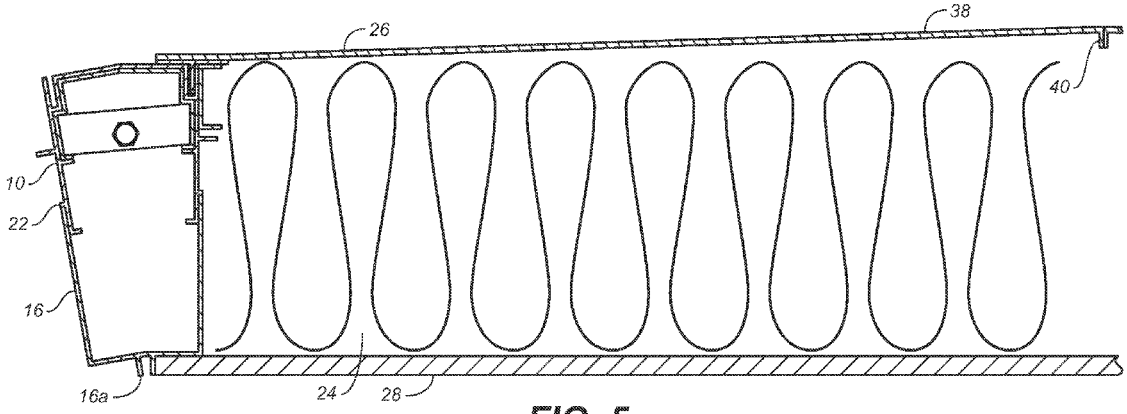
FIG. 5 is an end elevation cross-sectional view of a strut, inferior frame extension component, and exterior and interior panels.

FIG. 5 is an end elevation cross-sectional view of a strut, interior frame extension component, and exterior and interior panels. The interior of the framework is formed by interior frame extension component 16. This component fits over the interior side of the strut 10 by approximately one (1) inch. There is a an 1/8" ledge 22 built into the strut that acts as a "stop" for interior frame extension 16 and sets the overlap of the two components at one inch. Strut 10 and interior frame extension 16 are attached together with self drilling #6 sheet metal screws. The interior frame provides depth to the strut assembly allowing space 24 for thermal insulation between the exterior panels 26 and the interior panels 28. The hollow shape of the strut assembly 10 provides a pathway for installation of an air duct distribution system for delivery of conditioned air to the completed structure. Certain inside vertices are installed with grill openings for the distribution of conditioned air. The hollow strut assembly also provides a chase or pathway for electrical and other utility wires. Sheetrock (5/8" Type "x") interior panels 28 are directly attached to interior frame extension 16 with self drilling sheet metal screws. The gypsum panel provides a one hour fire separation barrier between the inside and outside of the structure.

Since the geometry of the geodesic is generated from the center of a sphere, all of the components, struts, vertices, and panels, are aligned toward the center of the structure. Strange acoustic anomalies occur when sound is generated from the center of the structure. The sound waves propagate outward and are reflected back to the center producing an echoic effect. In order to reduce the echoic effect, sound attenuation panels may be placed over the sheetrock panels to dampen the echoic reverberation. These panels consist of fabric wrapped acoustic insulation board. A vinyl/rubber trim strip in the form of a "T" may be inserted into the 1/4" channel **16*a* on interior frame extension 16**.

WATERPROOF EXTERIOR PANEL SYSTEM

Figure 6:
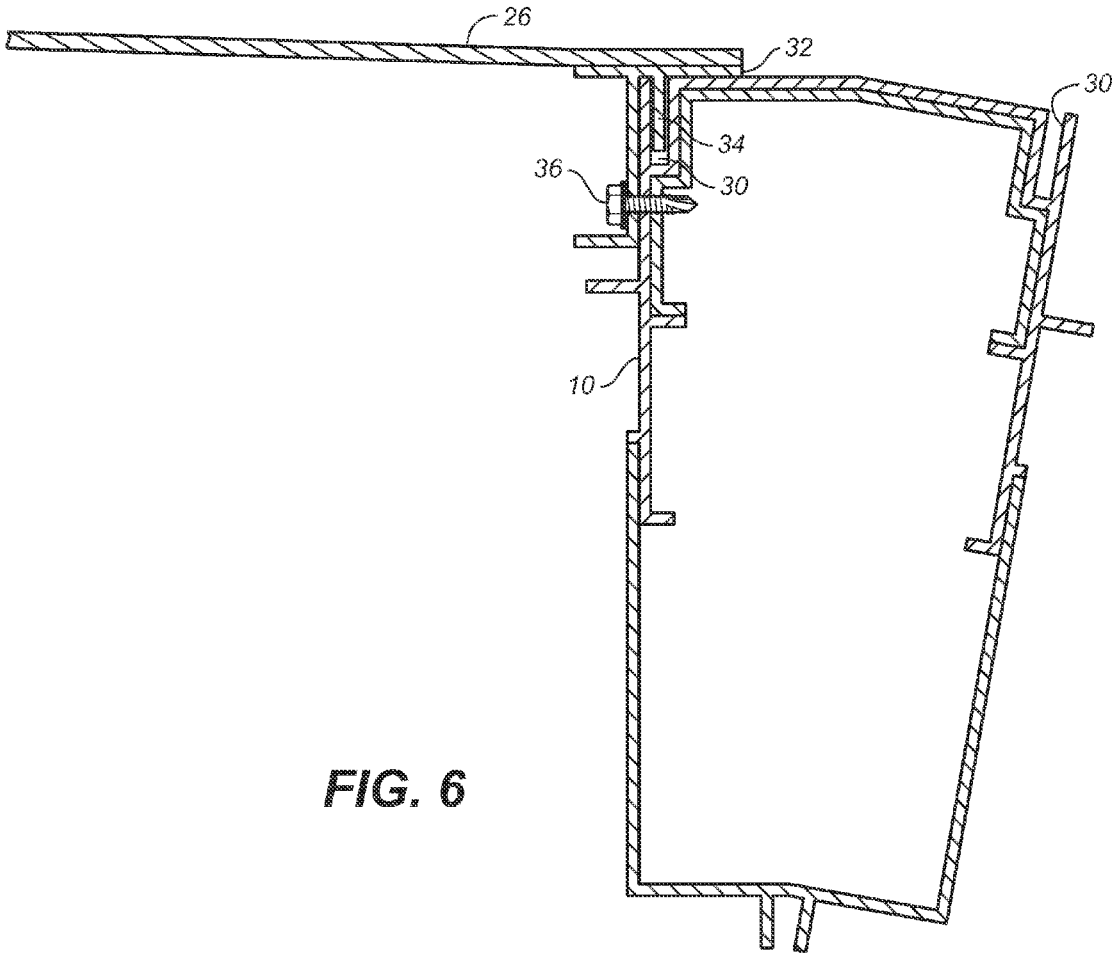
FIG. 6 is an end elevation cross-sectional view of the waterproof exterior panel system of this invention.

FIG. 6 is an end elevation cross-sectional view of the waterproof exterior panel system of this invention. The extruded shape that is fabricated into the struts 10 and vertex 12 components is configured with a continuous slot or keyway 30 on the outside surface of the struts and vertex components measuring 3/16" wide×7/8" deep. The continuous keyway is one of the primary elements for achieving a waterproof structure. The keyway does not penetrate through the strut or vertex components, it is a surface feature on the outside surface of the struts and vertex components.

Waterproofing is achieved by filling the continuous slot/keyway with polyurethane sealant and inserting the exterior panel 26 perimeter edge frame extrusion 32 into the slot. The edge frame 34 of the panel is a modified "T" form which presses into the slot filled with polyurethane sealant. The edge frame extrusion 32 is based on the combined shapes of a channel profile and a "T"-shaped profile. There are six different panel geometries on a four frequency Geodesic (based on the Icosahedron geometry). This extrusion 32 is cut and welded into a perimeter edge frame for the triangular panel shapes. The bottom edge or leg 34 of the "T" shape is cut so that it fits exactly into the continuous slot 30 of the dome framework. The panel frame 32 is attached to the aluminum sheet panel 26 with epoxy glue. The edges are then trimmed with a router to produce a smooth radius edge. The completed panel is installed into the geodesic framework by inserting the leg 34 of edge frame extrusion 32 into the continuous slot 30 of the framework, similar to a "zip-lock" arrangement. Once the spline portion of the panel is inserted into the slot or keyway (which is filled with silicone or polybutylene sealant) it interlocks with the frame to form a waterproof connection between the panel and the frame of the geodesic dome. The panels are compressed onto the framework during assembly by using clamps. The panels are permanently attached to the framework with self drilling sheet metal screws 36 that attach through edge frame extrusion 32 into the sides of the strut 10 framework. The adhesive force of the silicone or polybutylene sealant applied into the continuous slot is tremendous. After extrusion 32 is inserted into the continuous slot, the sealant cures and the panel becomes permanently attached to the framework. Through this installation and assembly procedure, the panels become interlocked with the framework, adding shear strength and creating a system that is strong, rigid, and waterproof.

Material Optimizing: In order to manufacture the triangular panels from standard aluminum sheets or rolls, the panels must be subdivided into smaller components. The aluminum industry produces both sheet stock and continuous rolls of alumnimum. The standard widths of both of these items measures four to five feet wide. In order to optimize the usage of standard materials, this invention breaks down the exterior panels (which are much larger than four to five feet wide) into three subdivision. Each inside edge of these smaller triangles is bent at 90 degrees at the interior seams. This produces a flange 40 (see FIG. 5) along the interior seams that is approximately ½" high. The purpose of this flange is two-fold: The flange reduces or eliminates heat distortion to the panel when the panel is continuously welded along the top of the flange during fabrication. In addition, the welded flange allows the panel, after it is fabricated, to expand and contract from the weather without distortion and without disturbing the weather-tight seal to the framework.

LOW PROFILE SKYLIGHTS

Figure 7:
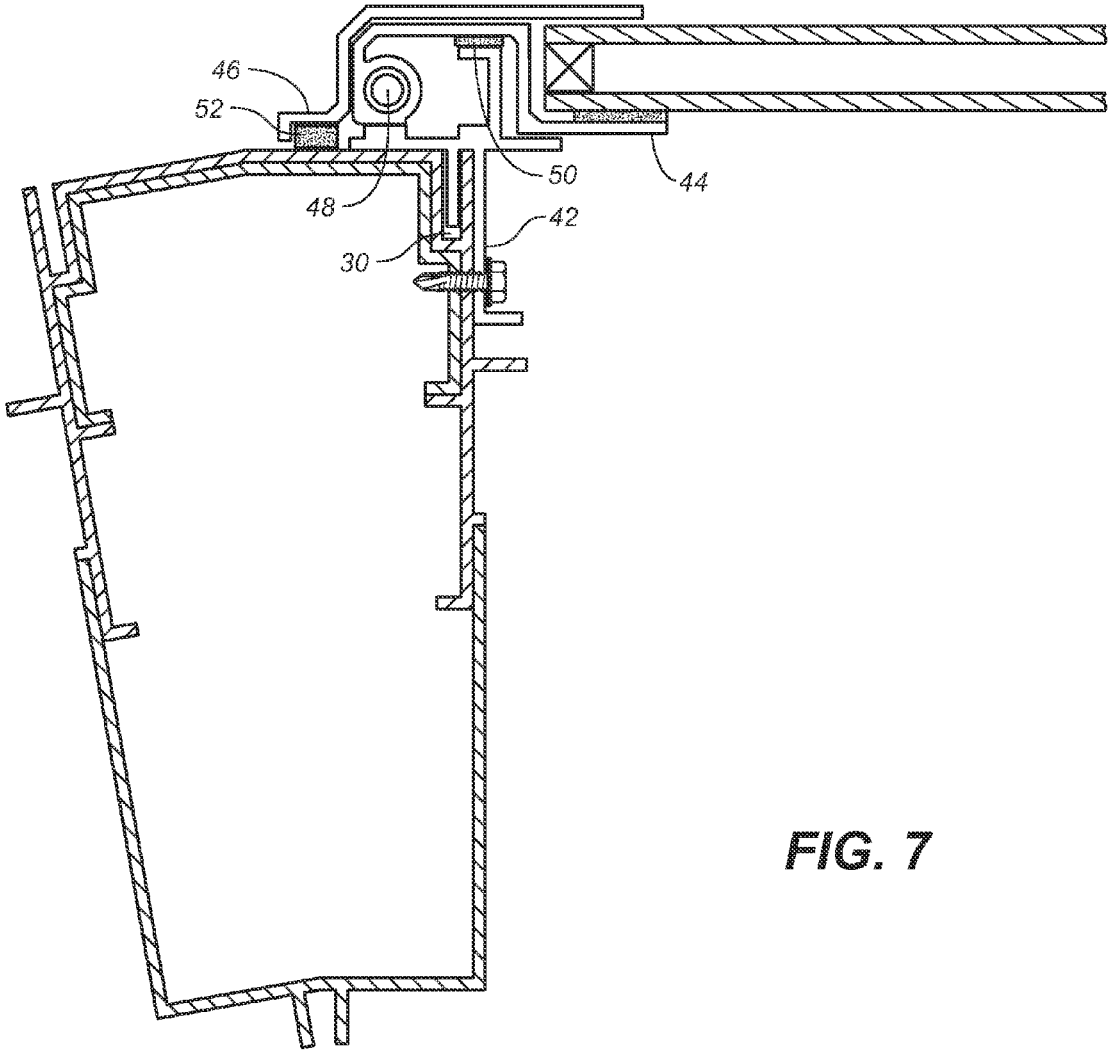
FIG. 7 is an end elevation cross-sectional view of a skylight as installed on the geodesic framework of this invention.

FIG. 7 is an end elevation cross-sectional view of a skylight as installed on the geodesic framework of this invention. Light and fresh air are introduced into the structure via operable skylights. All skylights are able to open and close. By strategically placing operable skylights at the base of the dome and at the top of the dome, a naturally aspirated "venturi effect" is created. As air inside the dome becomes heated, it rises to the top of the dome. When skylights are opened at the top of the dome and at the base of the geodesic dome, the colder air enters at the base of the dome and warmer inside air is released at the top, creating a natural draft. The design of the skylights allows any panel opening to be an operable skylight because the skylights use the same waterproof technology of a spline fitting into the slot that is built into the surface of the framework.

A full panel-sized skylight is heavy, due to the weight of the double pane insulated safety glass. The skylights are also precariously located on the convex exterior surface of the geodesic framework. To make this skylight system safe and waterproof, three aluminum extrusions are utilized: anchoring frame 42 is cut to exact lengths and welded into a triangular frame that fits exactly into the continuous keyway or narrow channel 30 that is located on the outer surface of the geodesic dome framework exactly like the aluminum sheet panels previously described. This component becomes a permanent structural frame to which the other parts of the skylight system are mounted and attached. The dual pane safety glass portion of the skylight is set into place on glass support 44 and covered with cover 46.

Glass support 44 is cut and welded into a triangular frame that matches the geometry of the opening in the geodesic framework. On the hinged side of the triangular frame, the hinge itself is created by cutting out four inch sections of the tubular portion of glass support 44 spaced every twelve inches. The cut-out portions are saved and welded to anchoring frame 42 and a solid aluminum rod 48 is inserted through the tubular section of glass support 44 including the four inch portions that are welded to anchoring frame 42. This arrangement is similar to a typical door hinge except that in this case the hinge is continuous along one edge of the triangular skylight. The skylight articulates open and closed along the full length of the hinge creating a very secure articulating attachment to the frame of the geodesic. Cover 46 covers the hinge and improves the appearance of the skylight. The open/close operation of the skylight is achieved by installing standard operating hardware. Where the skylights are located beyond reach, an electric motorized opening device is installed with a switch located at a convenient height.

The low profile (1.5") of the skylight is achieved by the interaction between glass support 44 and cover 46. Most standard skylights utilize a 6" high curb that is built onto the structure's framework. The skylight is then mounted onto the framework and overlaps the curb. That is the standard configuration for skylights. This invention uses a different approach. The form of glass support 44 has a rubber seal 50 which acts as a water stop. The location of the rubber seal is out of the path of the direct force of the water and the weight of the glass compresses the rubber seal and creates a fairly watertight seal, except under extreme conditions. However, wind driven horizontal rain will defeat the water barrier of this arrangement. To address this specific condition, cover 46 was designed with an additional rubber seal 52 to shield the skylight from a wind driven water onslaught. The two extrusions with the rubber seals attached create a design where cover 46 shields against the wind and stops most of the rainwater, then glass support 44 stops any water intrusion that was able to penetrate the seal created by cover 46.

DOME HOLD-DOWN BRACKETS

Figure 8:
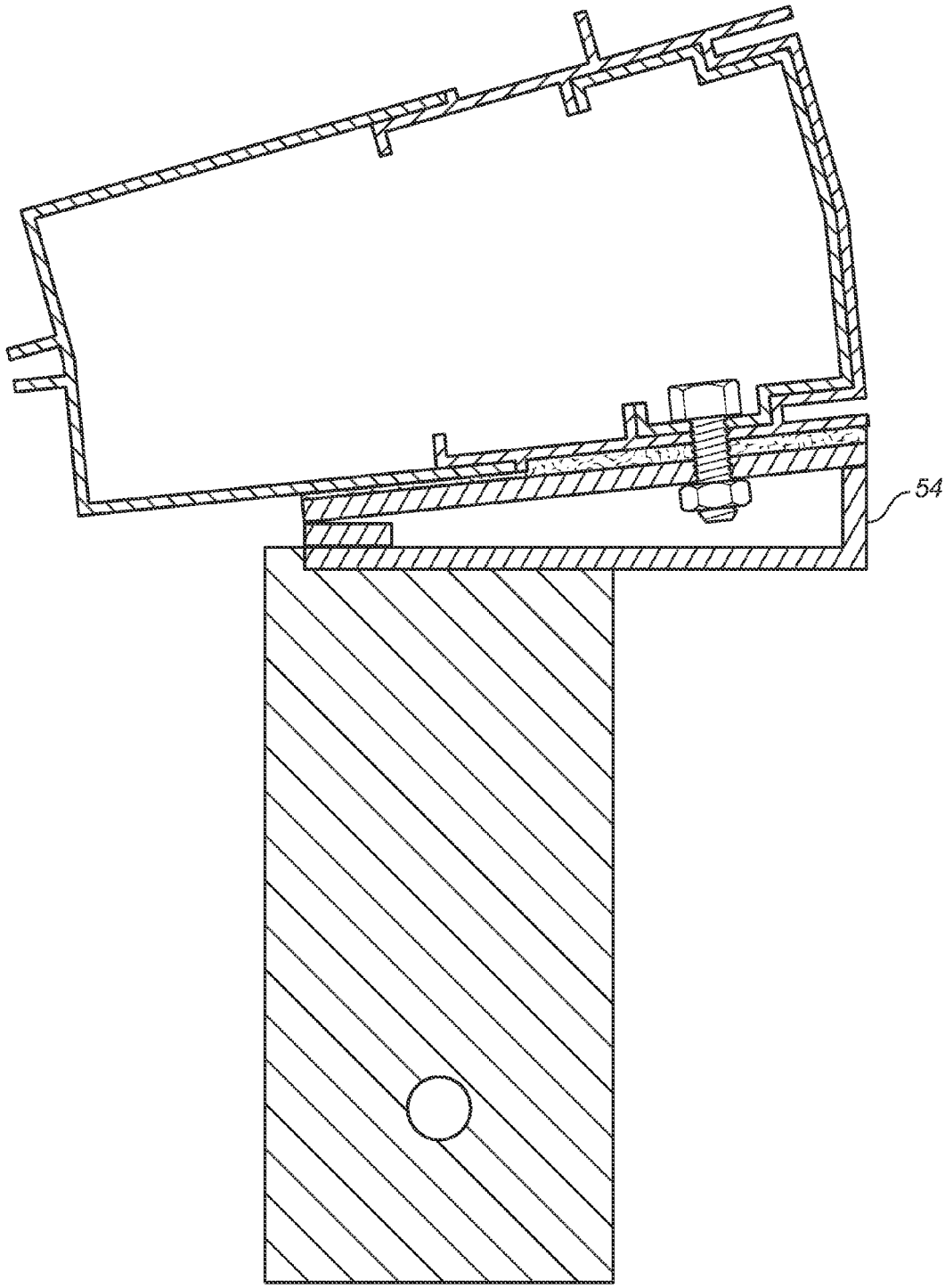
FIG. 8 is a side elevation cross-sectional view of a geodesic dome holdown bracket of this invention.

FIG. 8 is a side elevation cross-sectional view of a geodesic dome holdown bracket of this invention. When the geodesic is used as a roof system it is typically a portion of a full sphere. Usually a ⅜ cut-off or truncation is used, although a hemisphere, ⅝, or ¾ sphere could also be used. Whatever portion of a sphere is utilized, there needs to be a secure method for attaching the structure to a foundation or in the case of a second level installation, an attachment at the base of the structure to a beam. As mentioned before, the geodesic geometry generates from the hypothetical center of the sphere outward to the frame and panel components. If any cut-off point other than a hemisphere is used, then the base of the structure will be angled toward the center of the sphere. This invention utilizes a special bracket that is designed to take into account the angled plane of the base of the geodesic truncation and a flat surface such as a floor or foundation concrete slab. This bracket 54 connects the dome to the floor or to a beam and provides resistance from seismic and wind forces.

In summary, this invention is a system of interlocking components that are specifically designed to simplify the precision required for the successful construction of a complex geodesic structure. All of the necessary geometries for generating a geodesic structure are built into the system, thus allowing the builder to bypass the formidable technical hurdles associated with geodesic geometries. Water leakage in geodesic structures has been the most serious impediment toward general public acceptance of these structures. This invention has designed components that work at protecting the structure from the extreme forces of nature such as snow, wind, extreme heat, and wind driven rain. In addition to protection against weather conditions, this invention, by virtue of the interlocking component system's synergies, produces structures that are quite beautiful and affordable. The structures produced with this system are fireproof due to the all aluminum construction. This invention also complies with all building code requirements.

The above disclosure is sufficient to enable one of ordinary skill in the art to practice the invention, and provides the best mode of practicing the invention presently contemplated by the inventor. While there is provided herein a full and complete disclosure of the preferred embodiments of this invention, it is not desired to limit the invention to the exact construction, dimensional relationships, and operation shown and described. Various modifications, alternative constructions, changes and equivalents will readily occur to those skilled in the art and may be employed, as suitable, without departing from the true spirit and scope of the invention. Such changes might involve alternative materials, components, structural arrangements, sizes, shapes, forms, functions, operational features or the like.

Therefore, the above description and illustrations should not be construed as limiting the scope of the invention, which is defined by the appended claims.

What is claimed is:

1. Apparatus for constructing a geodesic sphere, said apparatus comprising:

a plurality of extruded struts, each having a cross-section, an outside surface with a keyway, and an interior side;

a vertex component having a plurality of strut segments, each of said strut segments having an outside surface with a keyway, an interior side, and a cross member, said strut segments having the same cross-section as that of said extruded struts;

a plurality of sliding connectors, each of which slidably fit into one of said extruded struts and one of said strut segments and include a cross member, each of said sliding connectors for joining one of said extruded struts to one of said strut segments of said vertex component to form a geodesic panel framing member having a continuous keyway extending from each of said strut segments of said vertex component to and along said extruded struts;

a fastener for adjustably connecting each of said cross members of each of said strut segments to one of said cross members of said sliding connectors;

a plurality of exterior panels, each having a perimeter edge sized for insertion into said continuous keyways so as to form a waterproof seal;

a plurality of interior frame extensions, each of which attaches to said interior sides of said extruded strut and said strut segments; and a plurality of interior panels attached to said interior frame extensions such that in construction each of said interior panels is spaced apart from one of said exterior panels so as to form an air space for thermal insulation;

wherein in assembly, one end of each of said sliding connectors is slidably inserted into a respective extruded strut of said extruded struts and the other end of each of said sliding connectors is slidably inserted into a respective strut segment of said strut segments so as to bring each cross member of said sliding connectors into proximity with a respective cross member of said cross members of said strut segments so as to form a small gap bridged by one of said fasteners, and wherein said fastener may then be employed to close the gap to produce localized compression in connecting said sliding connectors to said strut segments while simultaneously introducing tension throughout the geodesic sphere and using the closure of the small gaps for tensional tuning in the geodesic sphere.

2. The apparatus for constructing a geodesic sphere of claim 1 wherein each of said plurality of extruded struts has a centerline, and said centerline bears opposing dihedral angles down said centerline.

3. The apparatus for constructing a geodesic sphere of claim 1 wherein said vertex component generates both surface face angles on the geodesic sphere and axial angles on the geodesic sphere which produce a curvature of the geodesic.

4. The apparatus for constructing a geodesic sphere of claim 1 wherein each of said sliding connectors is bolted to one of said extruded struts.

* * * * *